United States Patent [19]

Wilkomirsky et al.

[11] 3,941,867

[45] Mar. 2, 1976

[54] PRODUCTION OF MOLYBDENUM TRIOXIDE FROM MOLYBDENITE IN A FLUIDIZED BED

[75] Inventors: Igor A. Wilkomirsky; Alan Paul Watkinson; J. Keith Brimacombe, all of Vancouver, Canada

[73] Assignee: Canadian Patents and Development Limited, Ottawa, Canada

[22] Filed: Sept. 4, 1974

[21] Appl. No.: 502,929

[52] U.S. Cl. ..... 423/53; 423/606; 423/659

[51] Int. Cl.[2] ..... C01G 39/00

[58] Field of Search ..... 423/53, 606, 659 F

[56] References Cited

UNITED STATES PATENTS

| | | | |
|---|---|---|---|
| 2,017,557 | 10/1935 | Winkler et al. | 423/53 |
| 3,770,414 | 11/1973 | Lake et al. | 423/53 |
| 3,833,352 | 9/1974 | Vojkouis | 423/606 |
| 3,848,050 | 11/1974 | Jemal | 423/606 |

*Primary Examiner*—Herbert T. Carter

*Attorney, Agent, or Firm*—Alan A. Thomson

[57] ABSTRACT

Molybdenite or $MoS_2$ materials, particularly finely divided flotation concentrates, are oxidized (roasted) to form molybdenum trioxide in a continuous composite fluidized bed containing non-elutriated refractory solids. A relatively high recycle ratio of oxidized calcine to feed is maintained for best results. The temperature of the circulated oxidized solids is maintained high to avoid sticking and deposition problems. High throughputs and high conversions have been achieved, with the product having a low sulfur content.

13 Claims, No Drawings

PRODUCTION OF MOLYBDENUM TRIOXIDE FROM MOLYBDENITE IN A FLUIDIZED BED

This invention concerns the production of molybdenum trioxide from molybdenum disulphide and molybdenum disulphide-containing materials by oxidation in a recirculating fluidized bed reactor. The reaction is performed with oxygen as follows:

$$MoS_2 + 7/2\ O_2 \rightarrow MoO_3 + 2\ SO_2$$

The process is carried out continuously in the reactor by feeding fresh molybdenite (molybdenum disulphide) and discharging the molybdenum trioxide.

The particular application seen for this process is in the production of molybdenum trioxide suitable for metallurgical e.g. ferromolybdenum alloys of chemical uses. The product obtained has low sulphur content (< 0.15%) and negligible amounts of molybdates. The fluidized bed system of the present invention has throughputs of at least 6 times the molybdenum trioxide of furnaces used in the prior art, with apparently about half the capital cost.

PRIOR ART

1. Kinetics of Molybdenum Disulphide Oxidation

Previous work in this field that has been published is summarized below:

The oxidation of molybdenite powder in air was studied at 280° to 550°C. At 430°/490°C, the rate was parabolic and linear at 550°C. The oxidation of molybdenite compressed into pellets at 360°/641°C, suggested that $MoO_2$ was formed as an intermediate compound. The oxidation of molybdenite pellets was studied by following the $SO_2$ evolution. The activation energy of 13.7 Kcal per mole for the overall reaction was calculated. It was again found that $MoO_2$ was formed as an intermediate compound during the oxidation. Others found also that $MoO_2$ was formed in a solid state reaction between $MoS_2$ and $MoO_3$ between 500° and 700°C. In the roasting of molybdenite concentrates in a pilot multiple hearth furnace, researchers detected also the presence of $MoO_2$ as an intermediate oxide.

During the roasting of molybdenite in an industrial multiple hearth furnace, the oxidation proceeded through a series of intermediate compounds of molybdenum, $MoO_2$, $Mo_4O_{11}$, $Mo_9O_{26}$, with simultaneous formation of $CaMoO_4$ and $FeO.MoO_4$ and $Fe_2O_3.MoO_4$. The kinetics of oxidation of molybdenum disulphide has been studied at 525° to 635°C, and it was found that a chemical reaction regime controlled the transformation until about 80% of the sulphur was oxidized. A probable diffusional regime exists at the end of the oxidation. The presence of sodium during oxidation of molybdenite has been found to have a deletereous effect on the rate of reaction.

2. Prior Art of Roasting Molybdenites

The oxidation of molybdenum disulphide to trioxide is industrially performed in reverberatory furnaces, rotary kilns and multiple hearth furnaces. The first two methods are used on a very restricted scale since the dust formed and sintering problems are magnified in these types of furnaces. Multiple hearth furnaces are widely used but have several disadvantages: dust entrainment accounts for 15 to 20% of the charge and is only partially converted to oxide. Volatilization of $MoO_3$ is important in the hottest hearths; molybdates are formed due to the solid reaction between $MoO_3$ and metal and metalloid oxides; sintering and agglomeration of material inside the furnace makes very frequent cleaning necessary; gas and particle leaks from the furnaces are difficult to avoid; and the furnaces have low capacity per unit area of hearth.

3. Prior Fluidized Bed Oxidation of Molybdenite

Attempts have been made in the past to avoid the above disadvantages by the use of fluidized bed reactors. A summary of published findings is as follows:

Zelikman et al. Tsvetyne Metally, No. 2, 65–70, (1966), described a pilot plant fluidized bed reactor to oxidize $MoS_2$ to $MoO_3$. Granulated molybdenite concentrates with bentonite as a binder, were oxidized at 570°–580°C. Calcines contained about 0.6% S. Approximately 42% of the charged material was entrained as dust and only partially converted. This product was recovered in a series of cyclones and filter bags and returned for granulation before recycling to the reactor.

Deev et al. Tsvetnye Metally, No. 4, 44–49, (1961), studied the oxidation of coarse $MoS_2$ in a batch fluid bed reactor and found that up to 400°C, the process is controlled by the chemical reaction, whereas above 400°C a transfer process controls the transformation.

Sada et al. Nippon Kogyo Kai Nippon Kogyo Shai, 81, No. 922, 254–255, (1965), also tried the oxidation of molybdenite in a tubular fluid bed at 630°–650°C using coarse particles of 35 to 60 mesh. Calcines discharged contained from 0.3 to 0.5% S. Entrained dust amounted to 56% of the charge of the reactor and contained from 2 to 4% S.

Grigoriu et al. Metalurgia (Bucharesti), 25, No. 1–2, 40–44, (1973), studied the kinetics of the oxidation of $MoS_2$ in a batch fluidized bed reactor using very coarse particles of 0.1 to 0.2 mm diameter at 450°/600°C. They obtained up to 85% sulphur oxidation.

In none of these prior fluidized bed processes has finely divided molybdenite, such as the concentrates that are obtained industrially by flotation, been fluidized directly. Nor has any attempt been made to continuously recirculate the entrained particles to obtain a fully converted discharge from the reactor. The low conversions, dust loss, solid deposits, plugging and long residence times for higher conversions have discouraged application of these prior fluidized bed processes.

THIS INVENTION

The process described herein for the oxidation of molybdenite or molybdenite-containing materials is based on a composite fluidized bed and on solids recirculation, and has the following advantages over the hearth processes in current use today:

a. at least 6 times greater throughputs per unit area of hearth;
b. lower capital investment;
c. lower operating and maintenance costs; and
d. potentially greater control of $SO_2$ emissions.

The process consists basically of several continuous operations:

a. feeding of molybdenite or molybdenite-containing material to the reactor,
b. fluidization and oxidation of the molybdenite in the reactor, c. elutriation of calcines out of the reactor and/or discharge of calcine from the reactor depending on the particle size of the feed, d. efficient separation of solids from the off-gas stream in a collection system, e. recirculation of a fraction of the calcines back to the reactor or to a second stage, and f. removal of the remaining fraction of calcines as product.

More particularly, the invention is a process for producing molybdenum trioxide from molybdenum disulphide materials, comprising:

a. feeding to and fluidizing said materials in a composite fluidized bed, the feed materials having a fine particle size of the order of molybdenite ore flotation concentrates, the bed including fluidized refractory particles which are not readily elutriated from the bed, and the fluidizing gas including oxygen;

b. oxidizing the fluidized molybdenum disulphide particles at a temperature within the range of about 450° to about 650°C;

c. withdrawing oxidized particles from the bed and separating entrained oxidized particles from the off-gas stream;

d. circulating at least part of the oxidized particles to again contact a fluidized bed as in (a) and (b), the weight ratio of recycle to feed being at least about 1:1, with the temperature during both (c) and (d) being maintained sufficiently high to prevent deposition of circulating solids and vapors; and (e) recovering molybdenum trioxide of low sulfur content from the oxidized particles.

The steps of the process are now described in more detail.

a. Feeding of fresh molybdenite and circulated calcines

Fresh molybdenite or molybdenite-containing materials may be fed to the reactor in one of several forms: in the wet as-filtered, or dried state, or in the form of a slurry. Any suitable device can be used to feed the molybdenite or molybdenite-containing materials and/or recirculated calcines to the reactor, but must be capable of minimizing the sintering or agglomeration of solids prior to their entry into the reactor. A screw feeding or piston-ejection device might be used. However, in this work a pneumatic injection device has been developed and found to be most suitable for this purpose. It consists of one or more modified venturi nozzles coupled to a dispersion nozzle inside the fluidized bed.

b. Fluidization and withdrawal of solids

The solids in the reactor are fluidized by an ascending stream of gas containing oxygen. The gas may suitably be air, air enriched with oxygen, or air + off-gas or fraction thereof, or mixtures of these. This same gas can be used for pneumatic feeding of solids. To improve the fluidization behaviour of the solids bed and to aid in the prevention of sintering and/or agglomeration of solids in the reactor under certain conditions, a fraction of the bed is comprised of refractory material whose particle size is usually greater than that of the calcines or the fresh feed. For example, a bed of silica sand has been successfully used in this work for the oxidation of molybdenite concentrates with a particle size of −325 mesh. The co-fluidization of such inert particles has been found very effective in preventing deposition, sticking and agglomeration of solids in the reactor. As a further measure to prevent build-up of solid material along the walls of the reactor, a vibratory or scraping device can be employed. In this work rotary arm blades rotating inside the reactor were used to good advantage but other means would serve the purpose. The calcines in the reactor are continuously elutriated or otherwise removed from the fluidized bed. The superficial gas velocity in the reactor required both to fluidize the solids and elutriate calcines depends on the particle size distribution of the molybdenite as well as the elutriation rate needed.

c. Oxidation of molybdenite in the reactor

The extent of oxidation of molybdenite in the reactor depends on several factors which include particle size distribution, oxygen partial pressure in the fluidizing gas, temperature and average solids residence time. Operation of the process, as outlined below and in the Examples given later for molybdenite concentrates, can be controlled to result in sulphur levels in the calcine of less than 0.15% wt.

d. Separation of solids from the off-gases

The calcines from the reactor are separated from the off-gases using a suitable collection system. Such systems as filter bags or electrostatic precipitators are operative but for this process a cyclone system discharging solids through a sealing mechanism has been found to be more advantageous. The discharged calcines are suitably separated into the recirculating and product streams by any distribution mechanism such as a simple immovable divider. However, a flap value has been utilized with advantage in this work.

Any calcine particles which have not been collected in the primary collection system described above can be collected in another system of suitable design such as a wet scrubber. The particles so collected can be recycled to a fluidized bed as a slurry or after a filtration step. Using such methods the discharged product can be greater than 98.5% of the molybdenite fed to the reactor. Rhenium in the off-gases can be recovered from the liquid if a wet scrubber is used.

e. Handling of the hot off-gas stream and recirculated solids

All parts and devices that handle hot gas and/or solids from the fluidized bed are maintained at a temperature sufficient to prevent buildup of solid material, usually well above 100°C. As a further measure to improve the flow of material, electromagnetic or mechanical vibrators or any other means of aiding material flow can be used. It may be desirable to recirculate part of the off-gas stream to build up the $SO_2$ concentration for efficient $SO_2$ removal.

f. Pretreatment of molybdenite feed having a high calcium level

To ensure acceptably low sulphur concentrations in the product calcine, the calcium content of the molybdenite or molybdenite-containing materials used for feed should be maintained at a low level. For example to achieve a sulphur level in the calcine of less than 0.15% the calcium content in the feed is kept below 0.2%. In cases where the as-received molybdenite material contains an unacceptably high calcium level, the calcium content can be reduced by a suitable treatment prior to the molybdenite material being fed to the reactor. A physical pretreatment may be possible, but a chemical treatment involving acid leaching has been used in this work. A dilute hydrochloric acid leachant has been found satisfactory but sulfuric or other acids could be used.

g. Operation as a multistage process

The process may also be operated in two or more stages to provide greater sulphide elimination in a lower total residence time where part or all of the product solids from the first stage reactor are fed to a second fluidized bed reactor.

h. Operating conditions

The fluidized bed can be operated within a wide range of conditions:

i. temperature: There is a practical lower limit to the possible operating temperature of the reactor as a result of the rapid decline in the rate of oxidation of molybdenite with decreasing temperature. Although lower temperatures may be possible, a lower limit of 450°C has been found preferable in this work. There is also an upper limit to the operating temperature as a consequence of the increase in sintering and agglomeration of solids in the reactor with increasing temperature. Although higher operating temperatures may be feasible in some cases, an upper limit of 650°C has been found preferable in this work. The fluidizing gas is suitably preheated as necessary to maintain the desired temperature.

ii. oxygen partial pressure: There is a lower limit to the oxygen partial pressure imposed by the decrease in the rate of molybdenite conversion with decreasing oxygen partial pressure. Although lower oxygen partial pressures may be possible in some situations, a practical lower limit is about 0.01 atm. The upper limits to oxygen partial pressure may be in excess of 1 atm. (as the fluidizing gas is under pressure).

iii. superficial gas velocity: The range of values of superficial gas velocity that may be employed depends on several variables including the minimum fluidization velocity, the particle size distribution and the rate of elutriation desired. For example, a practical range of superficial gas velocities has been found to be about 10 to 40 cm/sec. in this work for −325 mesh molybdenite concentrates.

iv. average solids residence time: There is a lower limit to the average solids residence time dictated by the need to obtain an acceptably high sulphur elimination from the molybdenite. A limit of at least about 1 hour has been determined as preferable in this process. The upper limit to the solids residence time is a function of such process variables as the size of the reactor and the capacity of the recirculating system, high average solids residence times requiring large reactors and recirculating systems. A practical upper limit of about 100 hours has been found for this system.

The optimum operating conditions will depend on several process variables including the particle size distribution of the molybdenite, the percentage sulphur elimination desired and the throughput of molybdenite to be oxidized. For the particular case of the oxidation using air, and feed of molybdenite flotation concentrates with a particle size of −325 mesh fed at a rate of about 257 kg/m$^2$ per day, the optimum operating conditions were found to be:

1. temperature 520°–560°C.
2. average solids residence time 15–25 hours.
3. superficial gas velocities 18 to 30 cm/sec.
4. recycle to feed ratio within 20:1 to 35:1.

SUMMARY OF FEATURES OF THIS INVENTION a. Molybdenite particles in the form of a slurry, as-filtered, or dried, can be fed to the bed. The particle size should be suitable for fluidization, and preferably elutriation from the composite bed with flotation concentrate of molybdenite ore found most suitable. These flotation concentrates are usually about 5 to 50 microns in diameter.

b. Calcines are withdrawn, usually by elutriation with separation from the off-gas stream and a fraction returned simultaneously and continuously to the reactor.

c. Refractory particles such as siliceous sand, alumina and magnesia whose particle size is preferably greater than that of the molybdenite are used to stabilize and improve the fluidization behaviour of the bed and to prevent agglomeration and/or sintering of solids in the reactor. The refractory particles may be selected to have a favorable effect on the rate of oxidation, but should be otherwise inert in the system. The particle size of the inert or refractory solids is such that they tend to remain behind on withdrawal of the calcine. The minimum size will depend on the density, particle shape etc. Where the calcine is withdrawn by elutriation, the size of the refractory particles is selected to minimize their elutriation with the calcine. A suitable particle size is usually within about −20 and +140 (U.S. Standard) or about 100–800 microns diameter.

d. All parts, conduits and devices that handle off-gas and/or circulating solids are kept at sufficiently high temperature usually well above 100°C and preferably 250°–350°C to prevent material build-up.

e. Rotary arm blades or other type of scraping device or vibratory device can be used inside the reactor to prevent any build-up of material.

f. pneumatic injection system comprised of one or more modified venturi nozzles connected to an injection nozzle inside the bed, or other suitable feeding system, can be employed to feed recirculated calcine and/or fresh feed, consisting of molybdenite or molybdenite-containing material, to the reactor.

g. Vibrators or other means of aiding material flow can be used to improve the movement of solids and gas outside the reactor.

h. A flap valve or other type of distribution device can be used to distribute the calcines from the collection system between the recirculating stream and the product bin.

i. The discharged product can be greater than 98.5% of material charged to the reactor.

j. The product calcines have a lower sulphur level (concentrations of sulphur below 0.15% are obtained) than other fluidized bed processes for molybdenite oxidation that have been reported in the past.

k. The process can use fluidizing and pneumatic feed gas with a considerable range of oxygen concentrations.

l. The process can be completely automated.

EXAMPLES

The following examples are given for the purpose of illustrating this process without intending to limit its scope:

Example 1

A fluidized bed roasting operation was carried out as follows:

Feed: $MoS_2$ concentrates −325 mesh at 256 Kg/m² per day.

Fluidizing gas: air.

Operating temperature of bed: 550°C.

Refractory solids in bed: silica sand of −30 +140 mesh.

Average residence time of solids: 27 hours.

Superficial gas velocity inside the reactor: 24.2 cm/sec.

Discharge calcines contained 0.108% Sulfur, with 99.73% efficiency of oxidation.

Discharge of reactor was 230 Kg/m² per day.

Recycle to feed ratio was 30:1.

Off-gas: 1.05 to 1.1% $SO_2$.

Example 2

A further fluidized bed roasting operation was carried out as follows:

Feed: $MoS_2$ concentrates −325 mesh at 256 Kg/m² per day.

Fluidizing gas: air.

Operating temperature of bed: 526°C.

Refractory solids in bed: silica sand of −30 +140 mesh.

Average residence time of solids was 27 hours.

Superficial gas velocity inside the reactor: 23.4 cm/sec.

Discharged calcines contained 0.119% Sulfur with a 99.70% efficiency of oxidation.

Discharge of reactor was 230 Kg/m² per day.

Recycle to feed ratio was 27:1.

Off-gases contained 1.05 to 1.10% $SO_2$.

We claim:

1. A continuous fluidized bed process for producing molybdenum trioxide from molybdenum disulphide materials, comprising:

a. feeding to and fluidizing said materials in a composite fluidized bed, the feed materials having a fine particle size of the order of molybdenite ore flotation concentrates and not significantly above about 50 microns in diameter, the bed including fluidized refractory particles which are not readily elutriated from the bed, and the fluidizing gas including oxygen;

b. oxidizing the fluidized molybdenum disulphide particles at a temperature within the range of about 450° to about 650°C;

c. withdrawing oxidized particles from the bed and separating entrained oxidized particles from the off-gas stream;

d. circulating at least part of the discrete oxidized particles to again contact a fluidized bed as in (a) and (b), the weight ratio of recycle to feed being at least about 1:1, with the temperature during both (c) and (d) being maintained sufficiently high to prevent deposition of circulating solids and vapors; said latter temperature being above about 250°C; and e. recovering molybdenum trioxide of low sulfur content from the oxidized particles.

2. The process of claim 1 wherein the oxidized particles are elutriated from the bed.

3. The process of claim 1 wherein the fluidizing gas is selected from air, air enriched with oxygen, and air diluted with recycled off-gas.

4. The process of claim 1 wherein the feed material particle size is within about 5 to about 50 microns diameter.

5. The process of claim 1 wherein the refractory particles are selected from siliceous sand, alumina and magnesia.

6. The process of claim 1 wherein the oxidation temperature in (b) is within about 520° to about 560°C.

7. The process of claim 1 wherein the weight ratio of recycled to feed particles is from about 1:1 to about 35:1.

8. The process of claim 1 wherein during the separation and circulation of oxidized particles the temperature is maintained above about 250°C and up to about 350°C.

9. The process of claim 1 wherein the withdrawn oxidized particles are fed to a second stage fluidized bed.

10. The process of claim 1 wherein the feed materials are in the form of a slurry or wet filter cake.

11. The process of claim 1 wherein the feed materials and recirculating oxidized particles are mixed and fed pneumatically to the fluidized bed.

12. The process of claim 1 wherein the molybdenum trioxide product has less than about 0.15% sulfur content.

13. The process of claim 1 wherein the feed materials are subjected to an acid leach to remove calcium impurities.

* * * * *